US005179235A

United States Patent [19]

Toole

[11] Patent Number: 5,179,235

[45] Date of Patent: Jan. 12, 1993

[54] PISTOL SIGHTING DEVICE

[76] Inventor: Ronald L. Toole, 2512 S.E. Lark, Milwaukie, Oreg. 97222

[21] Appl. No.: 757,478

[22] Filed: Sep. 10, 1991

[51] Int. Cl.[5] ..... F41G 1/35

[52] U.S. Cl. ..... 42/103; 362/110

[58] Field of Search ..... 42/103; 362/110, 111, 362/112, 113, 114

[56] References Cited

U.S. PATENT DOCUMENTS

| | | | |
|---|---|---|---|
| 1,070,883 | 8/1913 | Forrester | 362/114 |
| 1,120,769 | 12/1914 | Villarejo | 42/103 |
| 1,149,705 | 8/1915 | Ward | 42/103 |
| 1,191,528 | 7/1916 | Midgley | 362/114 |
| 1,215,171 | 2/1917 | Lewis | 42/103 |
| 1,263,667 | 4/1918 | Henderson et al. | 362/114 |
| 2,017,585 | 10/1935 | Casey | 362/114 |
| 2,629,516 | 2/1953 | Badham | 362/114 |
| 4,856,218 | 8/1989 | Reynolds, Jr. | 42/103 |
| 4,934,086 | 6/1990 | Houde-Walter | 42/103 |
| 4,939,863 | 7/1990 | Alexander et al. | 42/103 |
| 5,068,969 | 12/1991 | Siebert | 42/103 |

*Primary Examiner*—Michael J. Carone

*Attorney, Agent, or Firm*—Dellett, Smith-Hill & Bedell

[57] ABSTRACT

A laser sighting device for a pistol includes a universally mounted laser diode at the forward end of the pistol's trigger guard, wherein positioning of the laser beam is accomplished via adjustment screws from within the trigger guard. An energizing cable in the pistol structure is connected to a power supply located within the pistol's handgrip, and an externally operable activating switch is provided at the rear of the handgrip which is easily actuated by the user's hand immediately before the trigger is operated.

21 Claims, 4 Drawing Sheets

PISTOL SIGHTING DEVICE

BACKGROUND OF THE INVENTION

The present invention relates to a pistol sighting device and particularly to a laser sighting device adapted to form an integral part of a weapon.

A number of law enforcement agencies have recently started employing laser attachments in conjunction with regulation handguns. When the weapon is fired at predetermined range, a laser beam from a device mounted on the weapon can accurately predict the point of impact of the bullet even under conditions of moderate ambient light by projecting a spot upon the target. Not only does the use of such a laser sight ensure effectiveness with respect to the intended target, but also lessens the likelihood of unintended injury by a stray or inaccurately fired bullet.

Prior laser sighting devices have been in the nature of "add-on" structures attached to the police weapon in an obtrusive and ungainly manner so the weapon no longer can be received in a regulation holster. Moreover, such add-ons are easily damaged or unintentionally disengaged from the weapon unless considerable care is exercised with respect to their fragile structure. These devices can also be difficult to adjust in respect to the intended range of the weapon, and/or adjustment can be lost through mishandling such that the weapon can become more dangerous rather than more accurate.

SUMMARY OF THE INVENTION

In accordance with the present invention in a preferred embodiment thereof a laser gun sighting device is incorporated into a police pistol or the like for forming substantially an integral part thereof. A laser diode holder is mounted via universal positioning means at the forward end of the pistol trigger guard, such universal positioning means being easily adjustable for correcting the range and accuracy of the weapon. However, obtrusive parts do not extend outwardly from the weapon where they would be easily damaged or in a manner which would prevent the weapon from being received in a regulation holster.

In accordance with a particular embodiment of the present invention, a laser diode power supply is received substantially entirely within the handgrip portion of the weapon and is provided with switch means located immediately to the rear of the handgrip, operable by the user's hand at the same time the user's forefinger is placed in engagement with the trigger. A plurality of conductors within the weapon connect the power supply to aforementioned switching means as well as to the laser diode.

It is accordingly an object of the present invention to provide an improved sighting device for a pistol or similar weapon for enabling the dependable accuracy of such weapon.

It is another object of the present invention to provide an improved sighting device which is substantially integral with a pistol or similar weapon so as to avoid obtrusive parts as might be easily damaged or as might prevent the insertion of the weapon into a standard holster. It is another object of the present invention to provide an improved sighting device for a pistol or similar weapon wherein said sighting device is easily and accurately adjustable.

It is another object of the present invention to provide an improved sighting device for a pistol or the like which is easily operated by the user in conjunction with the operation of the weapon's trigger.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
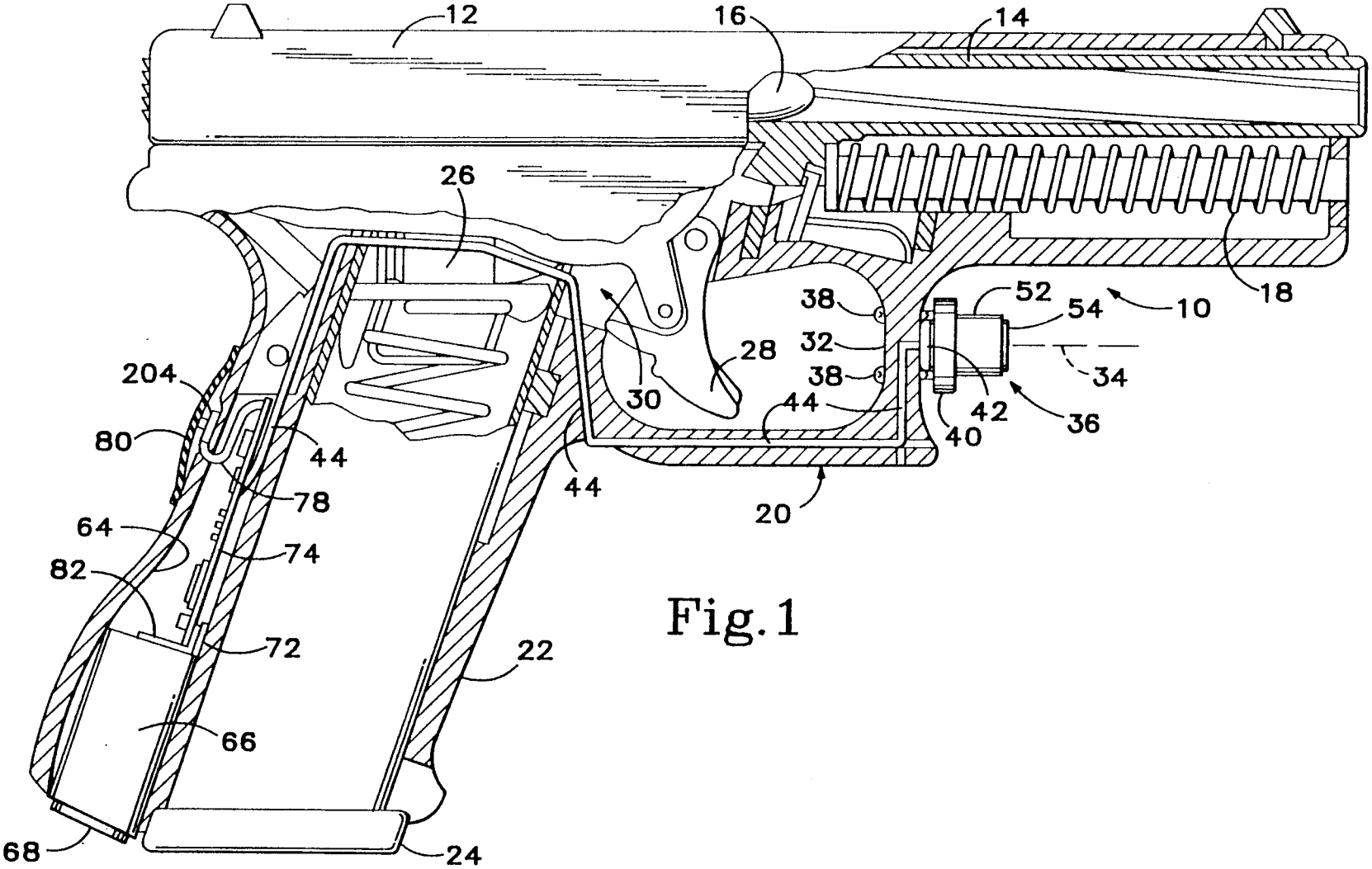
FIG. 1 is a longitudinal cross sectional view, partly broken away, of a standard pistol incorporating an integrally mounted sighting device according to the present invention.
Figure 2:
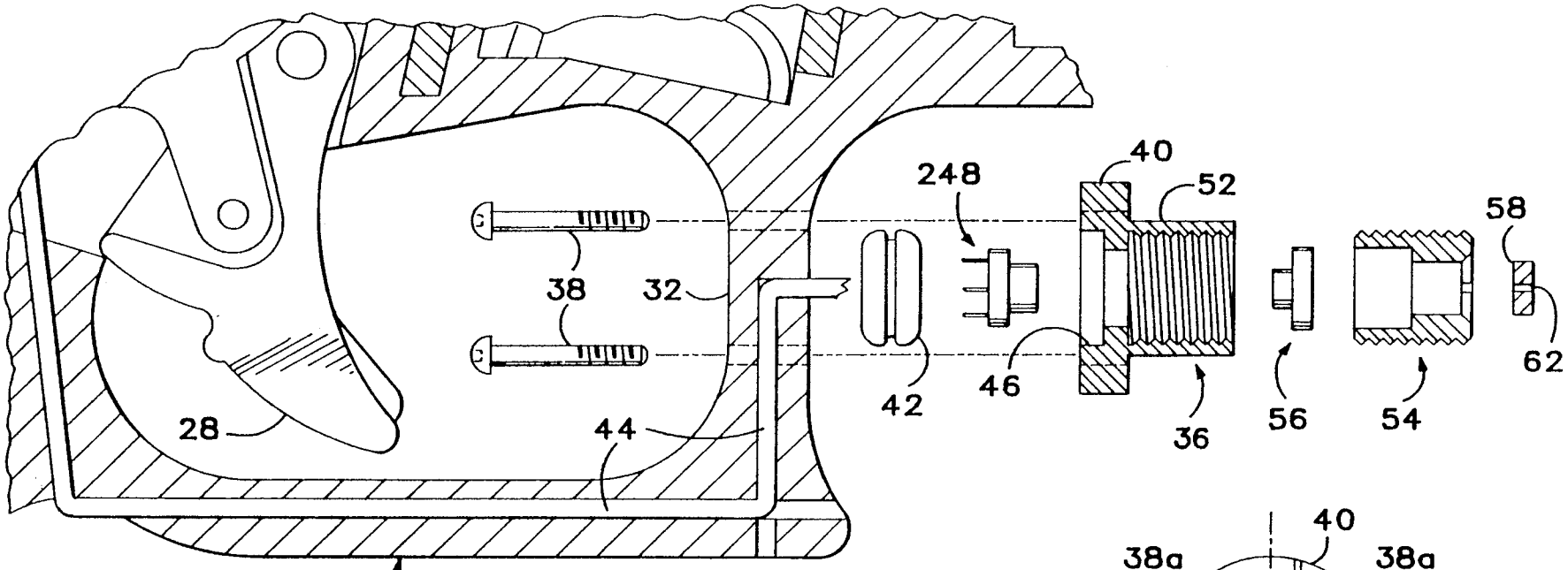
FIG. 2 is a detailed cross section of the trigger guard area of the FIG. 1 weapon, illustrating in greater detail and in exploded fashion the universal mounting of a laser device at the forward end of the weapon's trigger guard.

Referring to FIGS. 1–4, the sighting device according to the present invention is illustrated as mounted integrally with respect to a standardly employed police pistol, in this case a Glock 17. The pistol includes a frame 10 mounting a slide 12 and a barrel 14 for receiving a cartridge 16. The pistol frame is also provided with a recoil spring 18 and a trigger guard 20 both of which extend in a direction longitudinal of the weapon, i.e., in parallel relation to barrel 14. At the lower rear of the pistol, handgrip 22 contains a magazine well for receiving a cartridge clip 24 carrying one or more additional cartridges 26. Trigger 28 rotatably mounted within trigger guard 20 is adapted to operate trigger mechanism 30 in a manner understood by those skilled in the art for the purpose of firing the weapon and ejecting a bullet longitudinally from barrel 14.

In accordance with the present invention, a laser device is positioned on the pistol forwardly of trigger guard 20, e.g. on the forward, substantially vertical portion 32 of the trigger guard, the laser device providing a laser beam 34 which is projected in substantially intersecting relation with the trajectory of a bullet fired from barrel 14.

In particular, and in accordance with a preferred embodiment of the present invention, the laser device 248 (see FIG. 2) is mounted within a laser diode holder 36 provided with universal positioning means including threadably adjustable elements 38. Elements 38 suitably take the form of allen screws which extend horizontally (in a direction parallel to barrel 14) through holes in the forward portion 32 of the trigger guard for threaded engagement with radial flange 40 of laser diode holder 36. The heads of screws 38 are adapted to receive a right angle allen wrench which may be extended into the trigger guard from the side thereof whereby to adjust the position of flange 40.

The means for mounting the laser holder 36 further comprises a means for tiltably bearing the holder whereby adjustment of the screws 38 is employed for bringing about a desired degree of tilting of holder 36 with respect to the centerline of barrel 14 in order to properly aim laser beam 34. In the preferred embodiment, such means for tiltably bearing the holder comprises a compressible member 42 formed of elastomeric material. The member 42 is desirably a rubber grommet through which cable 44 is axially received, the wires of which are connected to the laser device in the manner illustrated in FIG. 5.

Figure 4:
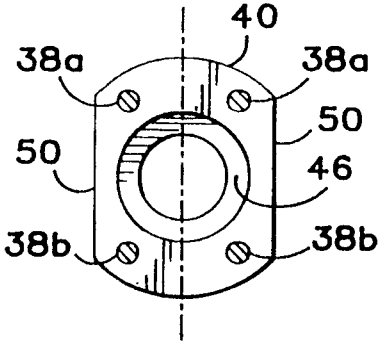
FIG. 4 is a transverse cross sectional view of a laser diode holder, said view being taken from the flanged side thereof as joined to screws 38.
Figure 3:
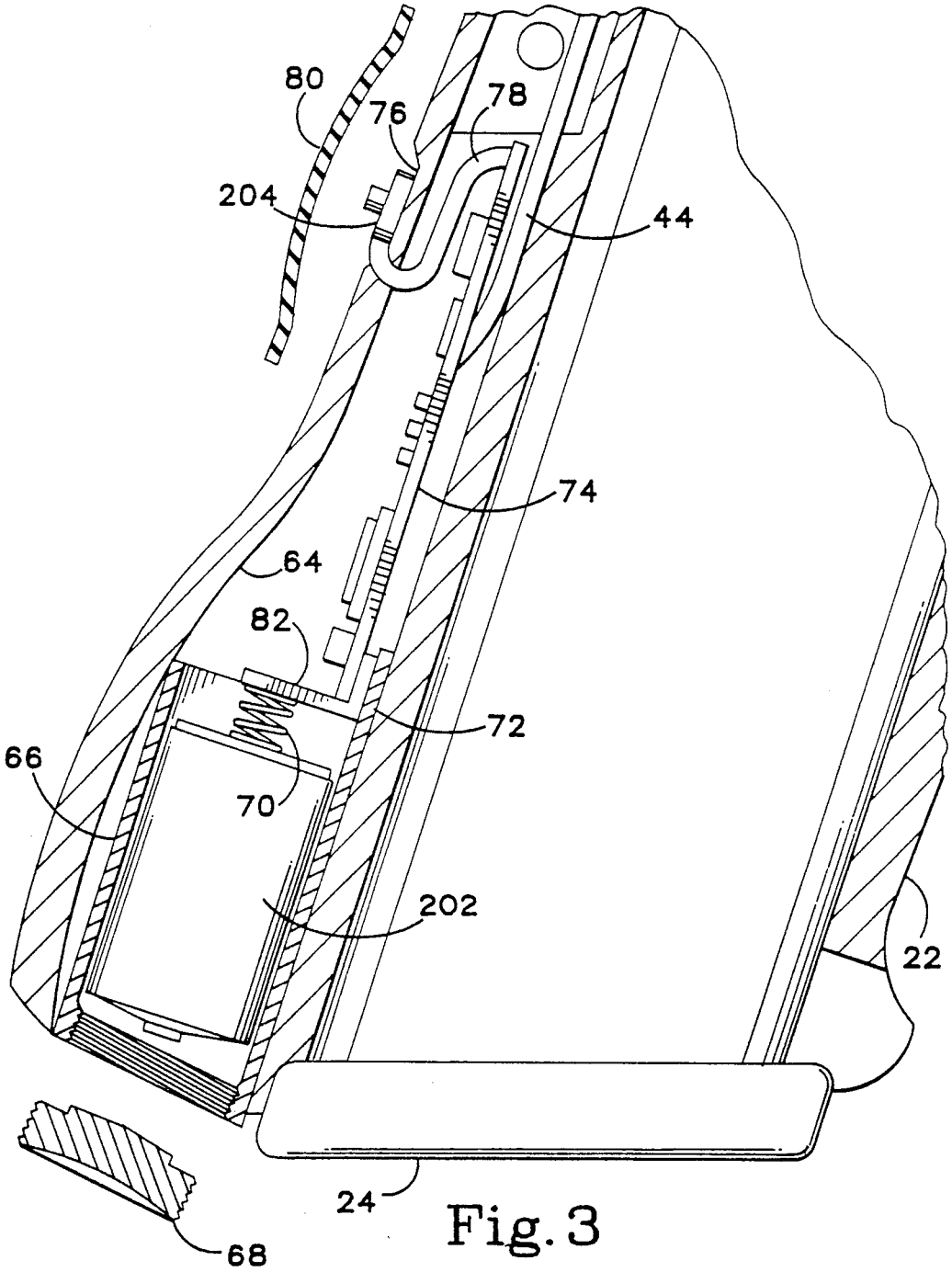
FIG. 3 is a cross sectional view of the handgrip portion of the FIG. 1 pistol illustrating the power supply and switching means employed in conjunction with the laser gun sight according to the present invention.

Four screws 38 are suitably employed to engage mating threaded holes in flange 40 as illustrated in the FIG. 4 cross sectional view. It is noted that flange 40, rather than being completely circular, is provided with left and right vertical edges 50 such that the width of the flange does not exceed the width of the trigger guard. The upper screws 38 (designated 38*a* in FIG. 4) engage threaded holes spaced equidistantly on either side of the centerline of flange 40 above vertical edges 50, while lower screws 38 (designated 38*b* in FIG. 4) are disposed equidistantly on either side of the vertical centerline of the flange below edges 50 and in substantial alignment below screws 38*a*. Respective adjustment of the screws 38 enables the individual adjusting of the sight to "rock" the laser diode holder 36, e.g. through tightening of one screw 38 and/or loosening the diagonally opposite screw 38 until the desired direction of beam 34 is procured. By adjustment of the various screws, the laser holder and therefore beam 34 is readily adjustable in both the horizontal or x direction, and in the vertical or y direction.

The final adjustment of the laser beam is undertaken at a point where all screws 38 are drawn up fairly tightly so that flange 40 nearly engages trigger portion 32 but is spaced therefrom by a sufficient distance so that the aforementioned adjustment can be accomplished. At this time, rubber grommet 42 is under compression and acts to provide back pressure on the laser diode holder for substantially locking the same at the desired orientation. Although four screws 38 are employed in the preferred embodiment of the present invention, a greater or lesser number can be utilized if so desired.

Laser diode holder 36 comprises a hollow cylindrical member, internally threaded at its axially forward cylindrical portion 52 to receive externally threaded lens carrier 54, while rearward flanged portion 40 is counterbored to provide recess 46 that receives laser diode device 248 which is locked into place within holder 36 by means of mechanically impressed punch marks or by another suitable expedient such as gluing whereby the laser beam produced thereby extends axially along the bore centerline of holder 36, and whereby electrical leads thereof extend rearwardly for connection to the conductors of cable 44 through the central aperture in grommet 42.

The internal bore of hollow externally threaded lens carrier 54 is adapted to receive an apertured disk 58 at the forward end thereof which is employed to determine the desired beam size. In a particular embodiment, the aperture 62 in disk 58 was 0.03 inches in diameter. Threaded lens carrier 54 is counterbored rearwardly to receive collimating lens 56, with both lens 56 and apertured member 58 suitably being cemented within the threaded member 54. The forward edge of lens carrier 54 is provided with an adjustment slot 60 so that the lens carrier is conveniently screwed into laser diode holder 36 and adjusted for the desired laser beam size and quality. A drop or two of a substance such as manufactured under the trademark Loctite may be placed upon the external threads of lens carrier 54 before insertion into diode holder 36 whereby a desired adjustment can be more easily maintained.

Although laser sighting adjustments are easily accomplished, it will be noted that the device is structurally quite sturdy and very compact, lacking clamp-on means or adjustment means as might be completely dislodged, resulting in inoperativeness of the entire sighting mechanism, or which may simply lose proper adjustment as contact is made with another object. The mechanism as positioned at the forward end of the trigger guard and within the width dimension of the pistol does not normally encounter abrasion by other objects either during normal operation or during insertion or removal from a regulation holster but is strong enough to withstand contact as may occur without losing adjustment. In particular regard to screws 38, it will be seen that directional adjustment of the laser beam is accomplished within trigger guard 20 as heretofore mentioned, ensuring lack of disturbance of the adjustment.

The power supply for the laser device is located within the rearward side of the handgrip behind the magazine well. In the case of the preferred embodiment, a power supply compartment is provided by removing excess material at the back of the handgrip to complete an elongated recess 64 in substantially parallel relation to the magazine well. This recess receives a battery holder 66 for housing battery 202, the holder having a convenient threadably engageable end cap 68. The positive terminal of the battery normally engages a raised rib on the inner side of end cap 68, while the remaining or negative terminal end of the battery contacts compression spring 70 held in place by means of battery spring retainer 82 having a conductive portion for completing the battery circuit. An upstanding flange 72 at the upper end of the battery holder, at its desired depth within recess 64, supports the battery spring retainer. The circuit board 74 incorporates circuitry comprising the power supply or driving circuit for the laser diode device, being connected thereto by the aforementioned cable 44 comprising three conductive wires covered by "shrink tube". The cable 44 extends from circuit board 74 up through the back of the handgrip and is suitably secured within a groove milled directly below the pistol operating rod. The cable 44 then passes successively through drilled bores in the rear of the trigger guard, the lower or horizontal portion of the trigger guard, and front portion 32 of the trigger guard from where the it extends through rubber grommet 42 to the laser device as mentioned. The battery holder is suitably cemented within recess 64.

An activating switch 204 is provided rearwardly of handgrip 22 and in particular comprises a pushbutton type switch located in a depression 76 milled at the upper rear of the handgrip. The switch is enclosed rearwardly by a rubber switch cover 80 which, like the pushbutton, is cemented to the rear of the handgrip. Two conductors from the switch 204 covered by "shrink tube" extend from the depression 76 through an aperture in the back of the handgrip under switch cover 80 and make proper connection with components on circuit board 74.

The activating switch 204 is positioned for convenient operation by the user of the pistol. As the user grasps the pistol with his forefinger inserted through the trigger guard 20 in front of trigger 28, his hand, between thumb and forefinger, is naturally positioned at the rear of the trigger guard whereby the switch 204 can be compressed as desired. Compression of switch 204 connects battery 202 to the power supply or driver circuit on circuit board 74 for properly energizing the three conductors within cable 44 whereby beam 34 is emitted forwardly for supplying an advance indication of the intersection of the bullet with the target.

In addition to advantages of sturdiness, ease and accuracy of adjustment, and integration with the weapon, it will be appreciated the device according to the present invention is easily incorporated into existing hand guns.

In a particular embodiment of the present invention a Toshiba laser diode device type TOLD 9211 was employed together with an appropriate power supply therefor. A schematic illustration of such a device together with an example of a power supply circuit are provided in FIGS. 5 and 6 respectively.

Figure 5:
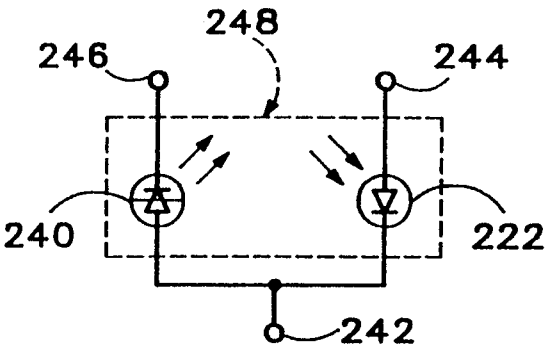
FIG. 5 is a schematic diagram of a laser device employed in accordance with the present invention.

Referring to FIG. 5 there is illustrated a configuration wherein a photo diode 222 is used to monitor the intensity of light emitted from laser diode 240, wherein both are physically mounted in the same envelope 248. The anode of laser diode 240 and the cathode of photo diode 22 are both coupled to terminal 242 while the cathode of laser diode 240 is connected to terminal 246 and the anode of photo diode 244 is connected to terminal 244. Since laser diodes are temperature-dependent in their operation, the current required to obtain a specific optical output varies with temperature. The linear relationship between the light intensity of the laser diode output and the resulting current passing through the photo diode is used to regulate this current.

Figure 6:
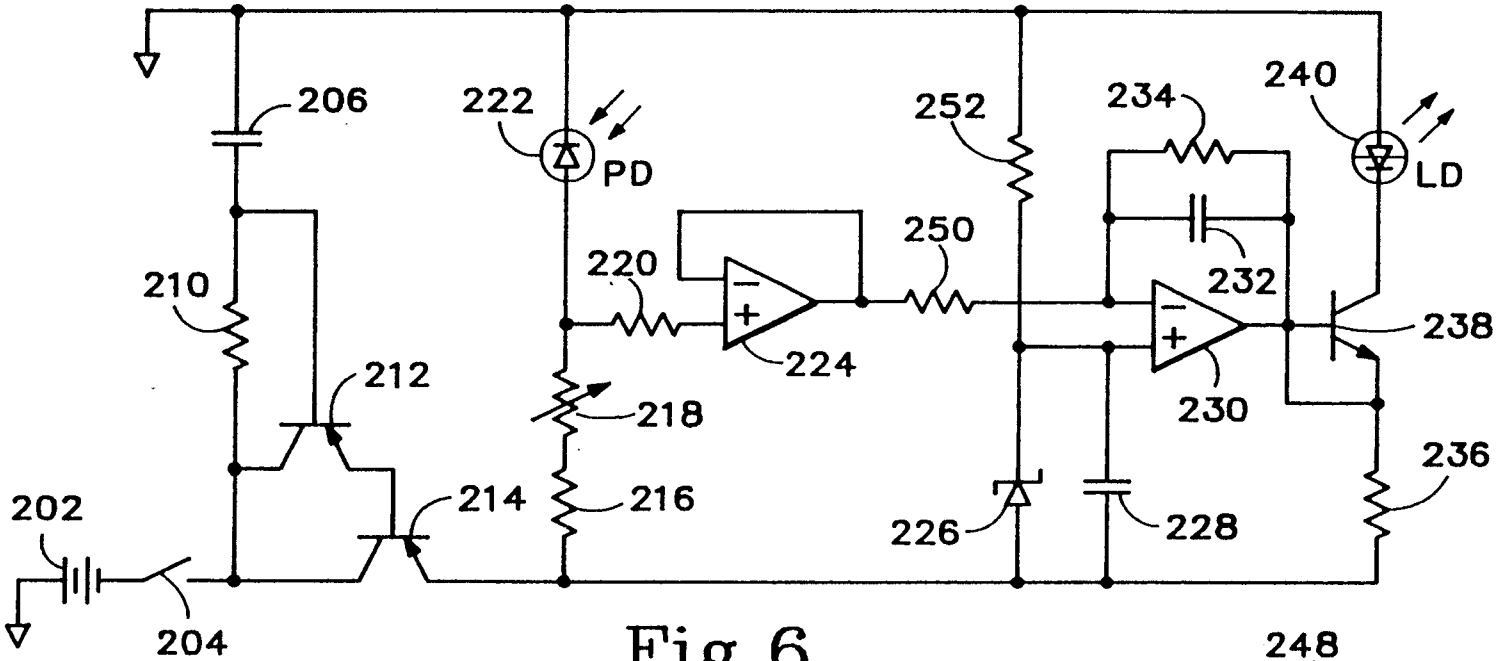
FIG. 6 is a schematic diagram of a power supply or driving circuit for the laser diode device employed with the present invention.

FIG. 6 is a schematic diagram illustrating a power supply or driving circuit for laser diode 240 and photo diode 222. The ungrounded terminal of a capacitor 206 is connected to the base of transistor 212 as well as to the first terminal of resistor 210. The negative terminal of battery 202 is coupled through switch 204 to the second terminal of resistor 210, the collector of transistor 212, and the collector of transistor 214, the base of the latter being coupled to the emitter of transistor 212. The emitter of transistor 214 connects to a first terminal of resistor 216, the anode of zener diode 226, a first terminal of capacitor 228 and a first terminal of resistor 236. Variable resistor 218 is interposed between the second terminal of resistor 216 and the anode of photo diode 222 having its cathode returned to ground. Resistor 220 couples the anode of photo diode 222 to the non-inverting input of op-amp 224 having an output connected by resistor 250 to the inverting input of op-amp 230. Op-amp 230 is connected at its non-inverting input to the cathode of zener diode 226, the second terminal of capacitor 228, and via resistor 252 to ground. Resistor 234 and capacitor 232 in parallel couple the inverting input of op-amp 230 to the emitter of transistor 238 and to the second terminal of resistor 236. The base of transistor 238 receives the output of op-amp 230 and is coupled at its collector to the cathode of laser diode 240, the anode of which is grounded.

Closing switch 204 is intended to result in a forward bias across laser diode 240 whereby current passing through the diode via resistor 236 and transistor 238 produces light emission. However, capacitor 206 and resistor 210 function in conjunction with transistors 212 and 214 to filter voltage spikes. For example, when switch 204 is initially closed, capacitor 206 conducts current providing a positive voltage across resistor 210 and shutting off transistor 212. Therefore the emitter of transistor 212 does not sink current from the base of transistor 214 and transistor 214 is shut off. Consequently laser diode 240 is back biased. As capacitor 206 charges, the voltage bias across the collector-base junction of PNP transistor 212 drops, turning on transistor 212 and allowing the emitter of transistor 212 to sink current from the base of transistor 214. The current passing through transistor 214 progressively increases for forward biasing laser diode 240. This gradual increase of current supplied laser diode 240 prevents damage due to instantaneous application of current. Of course, the whole procedure is completed in a fraction of a second.

As the current passing through laser diode 240 increases, the intensity of emitted light increases, and when the light intensity passes a threshold level, the current passing through diode 222 also begins increasing linearly. As a result, the voltage level at the non-inverting input of op-amp 224 rises, thereby increasing the voltage at the inverting input of op-amp 230. As the voltage at the inverting input of op-amp 230 rises above the voltage level set at the non-inverting input of op-amp 230, current is cut back to the base of transistor 238 and the current passing through transistor 238 decreases for reducing the amount of current passing through laser diode 240. As the light intensity of laser diode 240 decreases due to a reduction in current, the opposite sequence of events takes place. Variable resistor 218 provides an adjustable means for changing the light emission intensity of the laser diode by controlling the voltage at the non-inverting input of op-amp 224.

Also to prevent the laser diode from being damaged from rapid charges in supply current, the base current supplied to transistor 238 is integrated by op-amp 230. Resistor 234 and capacitor 232 serve as feedback controlling the rise and fall time for the output of op-amp 230.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A sighting device forming an integral part of a pistol, the pistol including a frame provided with a handgrip and a trigger guard location forwardly of the handgrip below the pistol's longitudinally extending barrel, comprising:

a laser device located on said pistol immediately forward of said trigger guard and beneath said barrel for projecting a laser beam in substantially intersecting relation to the trajectory of a projectile fired from said barrel, universal positioning means mounting said laser device to said pistol including means for adjusting the path of said laser beam in horizontal and vertical directions with said laser device mounted to said pistol, for aiming said laser device, and means for selectively empowering said laser device including power supply means mounted on said frame and conductor means for connecting said power supply means to said laser device.

2. A sighting device forming an integral part of a pistol, the pistol including a frame provided with a handgrip and a trigger guard located forwardly of the handgrip below the pistol's longitudinally extending barrel, comprising:

a laser device located on said pistol forwardly of said trigger guard and beneath said barrel for projecting a laser beam in substantially intersecting relation to the trajectory of a projectile fired from said barrel, universal positioning means mounting said laser device to said pistol including means for adjusting the path of said laser beam in horizontal and vertical directions, wherein said universal positioning means comprises mounting means extending from the forward end of said trigger guard, and means for selectively empowering said laser device including power supply means mounted on said frame and conductor means for connecting said power supply means to said laser device.

3. The apparatus according to claim 2 wherein said laser device comprises a laser diode.

4. The apparatus according to claim 2 wherein said power supply means is mounted within the handgrip of said pistol.

5. The apparatus according to claim 4 wherein said means for selectively empowering includes electrical switch means mounted at the rear of said handgrip for enabling operation of said power supply means to energize said device, said switch means being operable by pressure from the hand of the user between thumb and forefinger as the user's forefinger is inserted through said trigger guard.

6. The apparatus according to claim 2 wherein said mounting means comprises a laser diode holder and at least one adjustable element between said holder and the forward end of said trigger guard for producing relative motion between said holder and said trigger guard.

7. The apparatus according to claim 6 including a plurality of said adjustable elements wherein said adjustable elements comprise screws threadably engaging said holder and extending through the forward end of said trigger guard for adjustment from within said trigger guard.

8. The apparatus according to claim 6 wherein said mounting means further includes means for tiltably bearing said holder with respect to said trigger guard so that adjusting a said adjustable element tilts said holder.

9. The apparatus according to claim 8 wherein said means for tiltably bearing said holder comprises a compressible member located between said holder and said trigger guard, and between plural adjustable elements, so that said member becomes compressed as said adjustable elements are employed to draw said holder toward said trigger guard.

10. The apparatus according to claim 9 including four such adjustable elements in surrounding relation to said compressible member.

11. The apparatus according to claim 9 wherein said compressible member is formed of elastomeric material.

12. The apparatus according to claim 9 wherein said compressible member comprises a rubber grommet.

13. A sighting device forming a part of a pistol, said pistol including a frame provided with a handgrip and trigger means forward of said handgrip, comprising:

a laser device located on said pistol for projecting a laser beam in substantially intersecting relation to the trajectory of a projectile to be fired from said pistol, means for selectively empowering said laser device including power supply means mounted on said frame and switch means mounted at the rear of said handgrip for enabling said laser device, said switch means being operable as a result of pressure from the hand of the user between thumb and forefinger as the user's forefinger is in engaging relation with said trigger means, and an elastomeric cover for said switch means, said elastomeric cover being peripherally joined to said handgrip and receiving the pressure from the hand of the user over a relatively large area for operating said switch means.

14. The apparatus according to claim 13 wherein said power supply means is mounted within the handgrip of said pistol.

15. The apparatus according to claim 14 further including conductive leads within said pistol for connecting said switch means to said power supply means and for connecting said power supply means to said laser device.

16. A sighting device forming a part of a firearm, said firearm including a frame provided with a handgrip and trigger means forward of said handgrip, comprising:

a laser device located on said firearm for projecting a laser beam in substantially intersecting relation to the trajectory of a projectile to be fired from said firearm, and universal positioning means mounting said laser device to said firearm including means for adjusting the path of said laser beam in horizontal and vertical directions with said laser device mounted to said firearm, for aiming said laser device;

wherein said laser device comprising a laser diode and said mounting means comprises:

a laser diode holder and at least one adjustable element for producing relative motion between said holder and said firearm, and means for tiltably bearing said holder with respect to said firearm so that adjusting a said adjustable element tilts said holder.

17. The apparatus according to claim 16 including a plurality of said adjustable elements wherein said adjustable elements comprises screws threadably engaging said holder.

18. The apparatus according to claim 16 wherein said means for tiltably bearing said holder comprises a compressible member located adjacent said holder and between plural adjustable elements, so that said member becomes compressed as said adjustable elements are drawn up.

19. The apparatus according to claim 18 including four such adjustable elements in surrounding relation to said compressible member.

20. The apparatus according to claim 18 wherein said compressible member is formed of elastomeric material.

21. The apparatus according to claim 18 wherein said compressible member comprises a rubber element.

* * * * *

UNITED STATES PATENT AND TRADEMARK OFFICE

CERTIFICATE OF CORRECTION

PATENT NO. : 5,179,235

DATED : January 12, 1993

INVENTOR(S) : Ronald L. Toole

It is certified that error appears in the above-identified patent and that said Letters Patent is hereby corrected as shown below:

Col. 8, Line 43 Change "comprising" to --comprises--.
Col. 8, Line 67 Change "element" to --grommet--.

Signed and Sealed this

Eighteenth Day of May, 1999

*Attest:*

*Attesting Officer*

Q. TODD DICKINSON

*Acting Commissioner of Patents and Trademarks*